US005545060A

United States Patent [19]

Gow

[11] Patent Number: 5,545,060

[45] Date of Patent: Aug. 13, 1996

[54] CLAMPING TERMINAL UNIT

[75] Inventor: Neil Gow, Gloucestershire, United Kingdom

[73] Assignee: Krone Aktiengesellschaft, Berlin-Zehlendorf, Germany

[21] Appl. No.: 300,729

[22] Filed: Sep. 2, 1994

[30] Foreign Application Priority Data

Sep. 10, 1993 [DE] Germany ..... 43 31 212.8

[51] Int. Cl.[6] ..... H01R 9/22

[52] U.S. Cl. ..... 439/747; 439/718

[58] Field of Search ..... 439/709, 710, 439/711, 712, 713, 714, 715, 716, 717, 718, 719, 720, 721

[56] References Cited

U.S. PATENT DOCUMENTS

| | | | |
|---|---|---|---|
| 3,265,937 | 8/1966 | Sturdivan | 439/721 |
| 3,474,397 | 10/1969 | Piasecki | 439/721 |
| 3,723,948 | 3/1973 | Wyatt et al. . | |
| 4,040,709 | 8/1977 | Dola et al. . | |
| 4,210,379 | 7/1980 | Vachhani et al. | 439/717 |
| 4,245,880 | 1/1981 | Zimmerman et al. . | |
| 4,322,120 | 3/1982 | Rilling | 439/717 |
| 4,508,399 | 4/1985 | Dowling et al. . | |
| 4,527,849 | 7/1985 | Marach | 439/721 |
| 4,591,228 | 5/1986 | Vasseur | 439/717 |
| 4,790,770 | 12/1988 | Klaiber | 439/715 |
| 5,098,316 | 3/1992 | Köllman et al. | 439/717 |
| 5,295,810 | 3/1994 | Rei et al. | 439/717 |

FOREIGN PATENT DOCUMENTS

| | | |
|---|---|---|
| 2264216 | 7/1974 | Germany . |
| 2514263 | 10/1975 | Germany . |
| 246197A1 | 5/1987 | Germany . |
| 3912210A1 | 11/1989 | Germany . |
| 3938365C1 | 7/1991 | Germany . |
| 2161034 | 1/1986 | United Kingdom . |

*Primary Examiner*—Hien D. Vu
*Attorney, Agent, or Firm*—McGlew and Tuttle, P.C.

[57] ABSTRACT

The invention relates to a clamping terminal unit for electrical conductors in the power sector using insulation displacement technique. The clamping terminal unit forms a variety of different terminations in the medium voltage sector with medium currents that can reliably and rapidly be made. A housing 1 includes introduction openings 2 to insulation displacement contacts 3 for electrical conductors, an opening 4 and latch devices 14, 15 for the alignment of housings 1 and a recess 5 for the series arrangement of housings 1.

11 Claims, 4 Drawing Sheets

CLAMPING TERMINAL UNIT

FIELD OF THE INVENTION

The invention relates to a clamping terminal unit for electrical conductors in the power sector, and in particular to a terminal unit having insulation displacement contacts in a housing.

BACKGROUND OF THE INVENTION

In the sector of medium voltages and medium currents, approximately 220/240 volts and 16 amps, such as in domestic and industrial applications, electrical conductors are terminated at terminal devices, such as wall sockets, switches, or at electrical accessories by screw pressure or by clamping contacts. Such generally known and used connection or termination techniques require, however, a relative large expenditure due to the necessity to strip the conductors. The connections are of poor reliability, since screws frequently get loose due to vibrations, or since the clamping connections do not precisely grip the wires nor fix them with sufficient force. Loosening the screw connection is sometimes difficult, due to corrosion of the latter.

In the telecommunication sector, the so-called insulation displacement technique for terminating conductors to terminal devices or terminal blocks has been used for some time. The stripless insulation displacement termination for voice and data transmission is characterized by high reliability and easy handling. Such insulation displacement techniques are inexpensive, rapid and are field-proven in the telecommunication industry for solid as well as stranded copper cables of various types.

The application of insulation displacement termination techniques is partially known in the power sector, e.g. in the automotive industry. In U.S. Pat. No. 4,040,709, termination of a headlight unit to cables by an insulation displacement connection is proposed. In DE 39 12 210 A1, slots for pressing-in cables having insulation are provided. GB 2,161, 034 A discloses a solution for terminating lamps in series, wherein insulation displacement connection elements are also provided. The application of insulation displacement connection elements is also known in the art from U.S. Pat. Nos. 4,245,880 and 4,508,399 .

In DE 39 38 365 C1 there is described a wire connector comprising two identically shaped housing halves being latched with each other. The housing halves include guide channels and insulation displacement contacts arranged therein. The wire connector is not universal, however, but can only be used for connecting cable wires of the telecommunication technique.

It is disadvantageous, in all proposed solutions, in particular using the insulation displacement technique, that no universal application in the medium voltage sector is possible. Solutions are only proposed for a very limited special application, which cannot, or only hardly, be modified and adapted to user's requirements.

SUMMARY AND OBJECTS OF THE INVENTION

It is therefore the object of the invention to develop a clamping terminal unit of the type referred to hereinbefore, by means of which a variety of different terminations in the medium voltage sector with medium currents can reliably and rapidly be made.

The present invention is a clamping terminal unit that has a housing which defines a plurality of wire openings. Each of the wire openings has an electrical contact which is placed inside the housing. The electrical contacts have a wire contact means for electrically connecting with a wire that has been inserted through the wire opening. The housing also has a plurality of sides, namely a first lateral side, a second lateral side, a first end side and a second end side. On the housing is a lateral mechanical connection means for connecting other housings to the first and second lateral sides of the present housing. The lateral housings being similar to the present housing. The terminal unit also contains lateral electrical connection means which are electrically connectable to lateral electrical connection means of the first and second lateral housings. An end mechanical connection means is also provided on the housings for mechanically connecting the present housing with first and second end housings that are also similar to the present housing. These first and second end housings are connected to the first and second end sides of the present housing. A wall socket or gang box can also be provided with lateral electrical connection means for electrically connecting with electrical contacts in the housings.

The constructional design of the clamping terminal unit guarantees rapid, simple and reliable connection of 1 or 3-phase main lines to terminal devices and to domestic terminals, such as wall sockets and switches. These terminations are mechanically stable, have a low contact resistance, and are operable over long periods of time. The terminals are protected against being touched. In a simple manner, by an alignment or series arrangement of clamping terminal units, a variety of continuous electrical connections and/or branchings can be established, as required.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 *a* is a perspective top view of the clamping terminal unit of FIG. 1, with the position of the contacts being indicated;

DETAILED DESCRIPTION OF THE PREFERRED EMBODIMENTS

Figure 1:
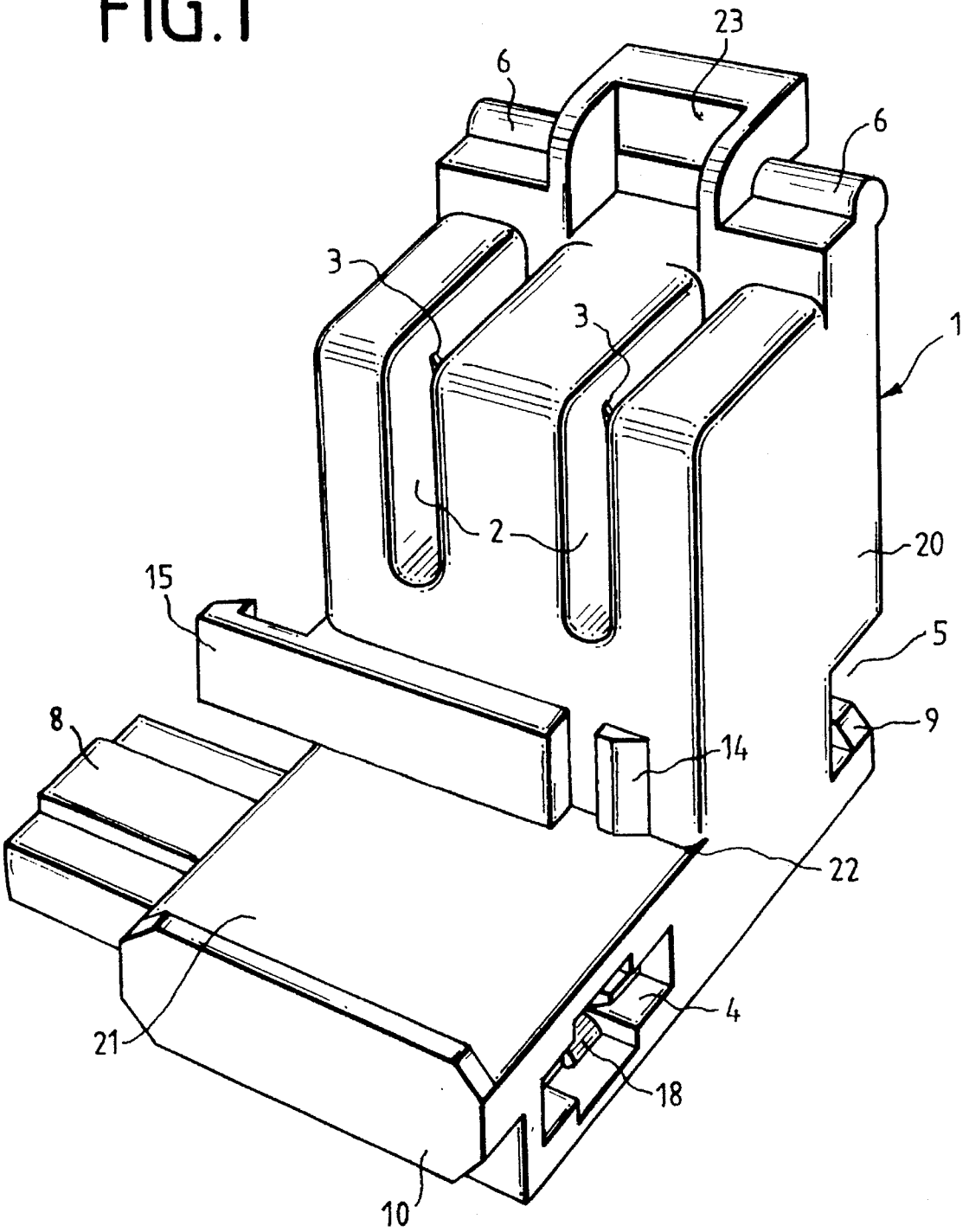
FIG. 1 is a perspective top view of the clamping terminal unit.

Referring to the drawings and in particular to FIG. 1, the clamping terminal unit of the present invention comprises a housing 1 with a first lateral side, a second lateral side, a first end side and a second end side. The housing 1 has an upper section that includes a column-type portion 20, two introduction wire receiving openings 2, latch positions 6, and a receiving portion 23. The housing 1 has a lower section with a recess 5 having a latch device 9. In an angled portion 22 of the housing 1, latch devices 14, 15 are provided. A portion 21 of the housing 1 extending from the angled portion 22 comprises an opening 4 in the first lateral side and a latch device 10. The introduction wire openings 2 serve to receive the electrical conductors (not shown) to be wired or connected. Inside the introduction openings 2 are situated insulation displacement electrical contacts 3 having wire contact means for the electrical termination of electrical conductors.

Figure 1A:
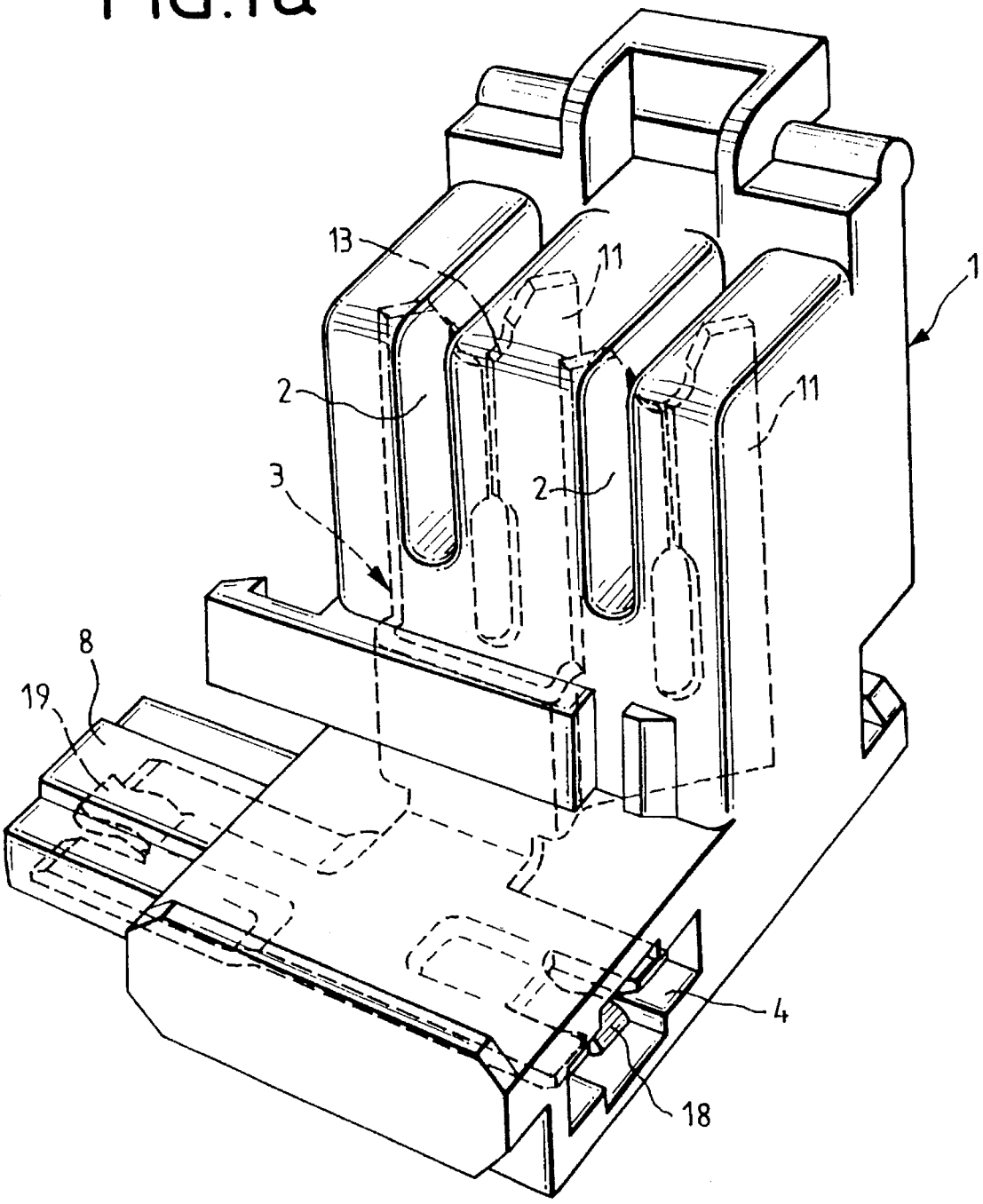
Figure 2:
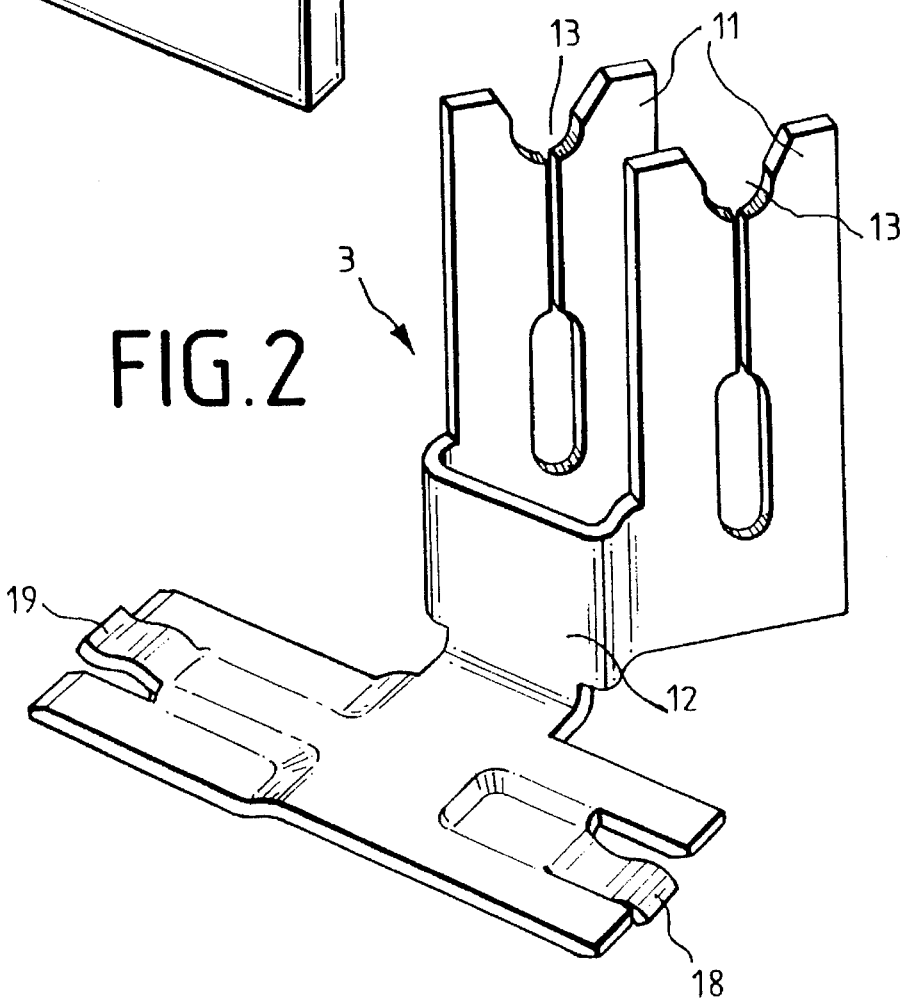
FIG. 2 is a perspective view of a contact.

According to the representation in FIG. 2, the wire contact means of the insulation displacement contacts 3 are composed of two insulation displacement contact elements 11 substantially parallely facing each other and being connected over a web 12 having a latch plate 27. The latch plate 27 is formed of latch/snap devices 18, 19. The latch/snap devices 18, 19 are accessible from outside the housing 1 through the opening 4, and serve for establishing an electrically conductive connection between several clamping terminal units. On the respectively other open side or second lateral side of the portion 21 of the housing 1, a cover element 8 is placed onto the latch/snap device 19, for protection against being touched or coming into contact with the surrounding environment (FIG. 1). The latch/snap devices 18, 19 are disposed at angle of substantially 45° to the web 12. From FIG. 1*a* can be seen the position of the contact 3 in the housing 1. The insulation displacement contact elements 11 are provided in the column-type portion 20 of the housing 1 such that the introduction openings 2 in the housing 1 match with the introduction slots 13 of the insulation displacement contact elements 11. The respective introduction slot 13 of the insulation displacement contact element 11 is, however, not parallel to the introduction opening 2, but is disposed at an angle of 45°.

Figure 3:
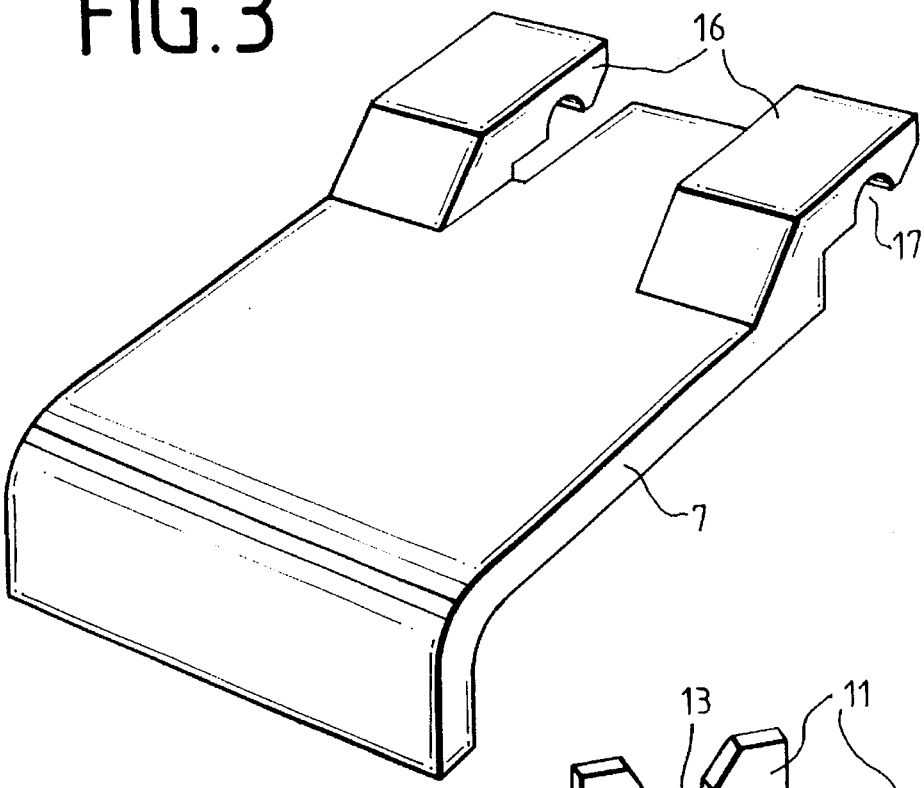
FIG. 3 is a perspective top view of the housing cap of the clamping terminal unit of FIG. 1.

A housing cap 7 shown in FIG. 3 serves for covering the introduction openings 2 with the insulation displacement contacts 3, and provides thus for a safe protection against being touched. The housing cap 7 is brought, with its latch tongues 16 provided with recesses 17, onto the latch positions 6 of the housing, and is latched there. The housing caps 7 have a display surface means, preferably the top surface in FIG. 3, for a marking of the line connections, e.g. identification of phase, neutral conductor or the like, can be performed by suitable color configurations.

Figure 4:
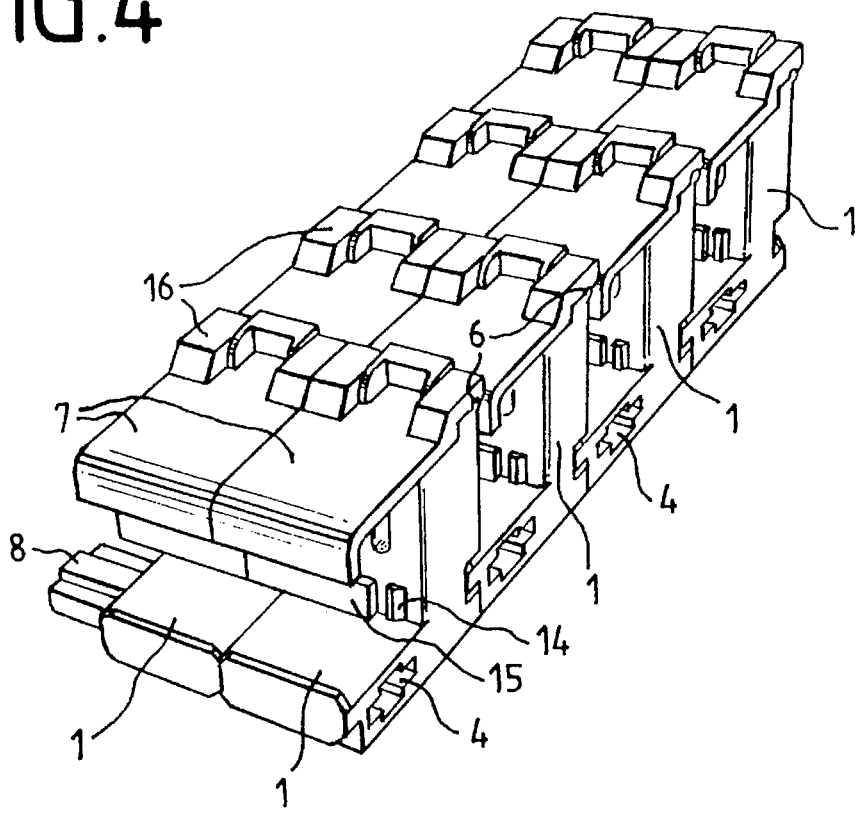
FIG. 4 is a perspective top view of a block of the clamping terminal units of FIG. 1.

FIG. 4, a perspective top view, shows an alignment and series arrangement of eight clamping terminal units with housing covers 7 and cover elements 8. The lateral alignment of clamping terminal units is achieved by lateral mechanical connection means which includes the latch devices 14 and 15 and by lateral electrical connection means which includes the latch/snap device 18 in the openings 4. A series arrangement is achieved by end mechanical connection means which includes the latch devices 9 and 10 (FIG. 1). The connection means being designed for making repeatable connections between terminal units without destroying the connection means. By means of the alignment or series arrangement of clamping terminal units, branches can be connected, so that additional terminals are available. An electrical contact and mechanical connection is established by the alignment arrangement of the clamping terminal units. The series arrangement of the clamping terminal units forms a mechanical connection only.

Figure 5:
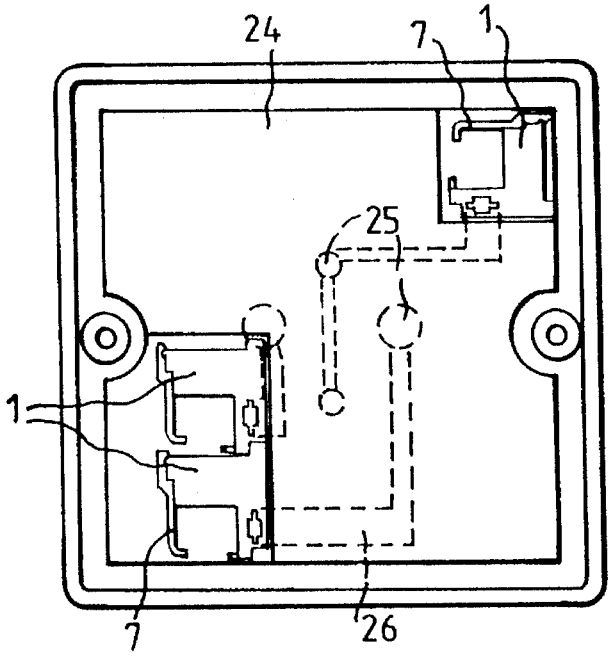
FIG. 5 is a clamping terminal unit of FIG. 1 when applied in a wall socket.

The clamping terminal units permit the quick and uncomplicated termination of domestic terminations to commercial terminals, such as wall sockets, switches and the like. The clamping terminal units are inserted into terminals (e.g. wall sockets), as required. An application of this kind is shown in FIG. 5. Therein, by the color codes of the housing caps 7, the line connections can be made visible towards outside, and false wiring can thus be avoided. The present invention can be used for the sector of 1-phase 220/240-volts networks, and for 3-phase 380/415-volts networks.

FIG. 5 shows the bottom view of a wall socket or gang box 24 with contacts 25 which are connected over contact strips 26 to a lateral electrical connection means of the gang box 24 to connect to electrical contacts of housings contained in gang box 24. Clamping terminal units with the housing 1 and the housing cap 7 are shown in FIG. 5 inside the gang box 24.

While specific embodiments of the invention have been shown and described in detail to illustrate the application of the principles of the invention, it will be understood that the invention may be embodied otherwise without departing from such principles.

What is claimed is:

1. A clamping terminal unit comprising:

a housing defining a plurality of wire receiving openings, said housing having a first lateral side, a second lateral side, a first end side and a second end;

a plurality of electrical contacts, each of said plurality of electrical contacts being positioned in one of said plurality of wire receiving openings, said each of said plurality of electrical contacts having wire contact means for electrically connecting with a wire, each of said wire contact means including an insulation displacement contact element;

lateral mechanical connection means positioned on said first and second lateral sides of said housing and for being connectable to a first lateral housing substantially similar to said housing on said first lateral side of said housing and for being connectable to a second lateral housing substantially similar to said housing on said second lateral side of said housing, said lateral mechanical connection means includes a first latch device positioned on said first lateral side of said housing said lateral mechanical connection means also includes a second latch device extending from said second lateral side of said housing;

lateral electrical connection means positioned in said first and second lateral sides of said housing and for being electrically connectable with said first lateral housing on said first lateral side of said housing and for being electrically connectable to said second lateral housing on said second lateral side of said housing, said lateral electrical connection means being electrically connected to said plurality of electrical contacts;

end mechanical connection means positioned on said first and second end sides of said housing and for being connectable to a first end housing substantially similar to said housing on said first end side of said housing and for being connectable to a second end housing substantially similar to said housing on said second end side of said housing.

2. A unit in accordance with claim 1, wherein:

said end mechanical connection means includes a first latch device positioned on said first end side of said housing, said end mechanical connection means also includes a recess defined by said second end side of said housing, said end mechanical connection means further includes a second latch device positioned in said recess.

3. A unit in accordance with claim 1, wherein:

each of said insulation displacement contact elements is positioned in one of said plurality of wire receiving openings of said housing, said insulation displacement contact elements being connected by a web and positioned at an angle to said web.

4. A unit in accordance with claim 1, further comprising:

a cap connected to said housing and coveting said plurality of wire receiving openings, said cap including two latch tongues each having a recess.

5. A unit in accordance with claim 4, wherein:

said cap has a display surface indicative of a type of connection.

6. A unit in accordance with claim 1, wherein:

said lateral electrical connection means includes a first latch/snap device positioned inside said housing and in correspondence with an opening defined by said first lateral side of said housing, said lateral electrical connection element also including a second latch/snap device extending outwardly from inside of said second lateral side of said housing and a cover element extending from said second lateral side of said housing and positionable over said second latch/snap device.

7. A unit in accordance with claim 1, wherein:

said lateral mechanical connection has a first part and a second part, said first part being positioned on said first lateral side of said housing and connectable to a second part of a lateral mechanical connection means on said second lateral side of said first lateral housing, said second part of said lateral mechanical connection means of said housing being positioned on said second lateral side of said housing and connectable to a first part of a lateral mechanical connection means on said first lateral side of said second lateral housing;

said lateral electrical connection has a first part and a second part, said first part being positioned in said first lateral side of said housing and connectable to a second part of a lateral electrical connection means in said second lateral side of said first lateral housing, said second part of said lateral electrical connection means of said housing being positioned in said second lateral side of said housing and connectable to a first part of a lateral electrical connection means in said first lateral side of said second lateral housing;

said end mechanical connection has a first part and a second part, said first part being positioned on said first end side of said housing and connectable to a second part of a end mechanical connection means on said second end side of said first end housing, said second part of said end mechanical connection means of said housing being positioned on said second end side of said housing and connectable to a first part of a end mechanical connection means on said first end side of said second end housing.

8. A unit in accordance with claim 1, wherein:

said first and second lateral sides of said housing are substantially opposite;

said first and second end sides of said housing are substantially opposite;

said wire receiving openings are on a side of said housing substantially perpendicular to said first and second lateral and end sides.

9. A unit in accordance with claim 1, further comprising:

a gang box with lateral electrical connection means for electrically connecting with said lateral electrical connection means positioned in said housing.

10. A unit in accordance with claim 1, wherein:

said wire contact means is positioned in one of said wire receiving openings, said wire contact means electrically connects directly to a wire inserted into said one of said wire receiving openings.

11. A clamping terminal unit comprising:

a housing defining a plurality of wire receiving openings, said housing having a first lateral side, a second lateral side, a first end side and a second end side;

a plurality of electrical contacts, each of said plurality of electrical contacts being positioned in one of said plurality of wire receiving openings, said each of said plurality of electrical contacts having wire contact means for electrically connecting with a wire;

lateral mechanical connection means positioned on said first and second lateral sides of said housing and for being connectable to a first lateral housing substantially similar to said housing on said first lateral side of said housing and for being connectable to a second lateral housing substantially similar to said housing on said second lateral side of said housing;

lateral electrical connection means positioned in said first and second lateral sides of said housing and for being electrically connectable with said first lateral housing on said first lateral side of said housing and for being electrically connectable to said second lateral housing on said second lateral side of said housing, said lateral electrical connection means being electrically connected to said plurality of electrical contacts, said lateral electrical connection means including a first latch/snap device positioned inside said housing and in correspondence with an opening defined by said first lateral side of said housing, said lateral electrical connection element also including a second latch/snap device extending outwardly from inside said second lateral side of said housing and a cover element extending from said second lateral side of said housing and positionable over said second latch/snap device;

end mechanical connection means positioned on said first and second end sides of said housing and for being connectable to a first end housing substantially similar to said housing on said first end side of said housing and for being connectable to a second end housing substantially similar to said housing on said second end side of said housing.

* * * * *